US007644518B2

(12) United States Patent
Chandler et al.

(10) Patent No.: US 7,644,518 B2
(45) **Date of Patent: *Jan. 12, 2010**

(54) STRUCTURAL ELEMENT FOR A SHOE SOLE

(75) Inventors: Matthew Daniel Chandler, Nuremberg (DE); Timothy David Lucas, Erlangen (DE); Jan Hill, Grobenseebach (DE); Robert Leimer, Nuremberg (DE); Mark Andrew Henderson, Portland, OR (US); Angus Wardlaw, Nuremberg (DE); Charles Griffin Wilson, III, Portland, OR (US); Gerd Rainer Manz, Weisendorf (DE)

(73) Assignee: adidas International Marketing B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 12/036,727

(22) Filed: Feb. 25, 2008

(65) Prior Publication Data

US 2008/0155859 A1 Jul. 3, 2008

Related U.S. Application Data

(63) Continuation of application No. 11/396,414, filed on Mar. 31, 2006, now Pat. No. 7,350,320, which is a continuation of application No. 11/346,998, filed on Feb. 3, 2006, now Pat. No. 7,401,419, and a continuation-in-part of application No. 10/619,652, filed on Jul. 15, 2003, now Pat. No. 7,013,582.

(30) Foreign Application Priority Data

| | | |
|---|---|---|
| Jul. 31, 2002 | (DE) | 102 34 913 |
| Mar. 28, 2003 | (EP) | 03006874 |
| Feb. 11, 2005 | (DE) | 10 2005 006 267 |

(51) Int. Cl.
*A43B 13/18* (2006.01)

(52) U.S. Cl. ..... 36/28; 36/25 R; 36/27

(58) Field of Classification Search ..... 36/25 R, 36/28, 30 R, 27, 29, 103
See application file for complete search history.

(56) References Cited

U.S. PATENT DOCUMENTS

| | | | |
|---|---|---|---|
| 1,841,942 | A | 1/1932 | Fenton |
| 2,224,590 | A | 12/1940 | Boivin |
| 2,547,480 | A | 4/1951 | McDaniel |
| 2,863,231 | A | 12/1958 | Jones |
| 3,834,046 | A | 9/1974 | Fowler |
| 4,000,566 | A | 1/1977 | Famolare, Jr. et al. |
| D247,267 | S | 2/1978 | Dolinsky |
| 4,083,125 | A | 4/1978 | Benseler et al. |
| 4,130,947 | A | 12/1978 | Denu et al. |
| 4,139,187 | A | 2/1979 | Hanusa |
| 4,183,156 | A | 1/1980 | Rudy |

(Continued)

FOREIGN PATENT DOCUMENTS

| | | |
|---|---|---|
| DE | 41 14 551 | 5/1992 |

(Continued)

*Primary Examiner*—Ted Kavanaugh
(74) *Attorney, Agent, or Firm*—Goodwin Procter LLP

(57) ABSTRACT

The present invention relates to a shoe sole including a cushioning element. The shoe sole can include a heel cup or heel rim having a shape that substantially corresponds to the shape of heel of a foot. Further, the heel part can include a plurality of side walls arranged below the heel cup or rim and at least one tension element that interconnects at least one side wall to another side wall or to the heel cup or rim. The heel cup or rim, the plurality of side walls, and the at least one tension element can be integrally formed as a single piece.

17 Claims, 12 Drawing Sheets

U.S. PATENT DOCUMENTS

| | | | |
|---|---|---|---|
| 4,224,774 | A | 9/1980 | Petersen et al. |
| 4,236,326 | A | 12/1980 | Inohara |
| 4,296,557 | A | 10/1981 | Pajevic |
| 4,297,796 | A | 11/1981 | Stirtz et al. |
| 4,314,413 | A | 2/1982 | Dassler et al. |
| 4,316,332 | A | 2/1982 | Giese et al. |
| 4,354,318 | A | 10/1982 | Frederick et al. |
| 4,364,189 | A | 12/1982 | Bates |
| 4,364,190 | A | 12/1982 | Yonkers |
| 4,391,048 | A | 7/1983 | Lutz et al. |
| 4,438,573 | A | 3/1984 | McBarron |
| 4,451,994 | A | 6/1984 | Fowler |
| 4,492,046 | A | 1/1985 | Kosova |
| 4,498,251 | A | 2/1985 | Shin et al. |
| 4,506,461 | A | 3/1985 | Inohara et al. |
| 4,507,879 | A | 4/1985 | Dassler et al. |
| 4,523,393 | A | 6/1985 | Inohara et al. |
| 4,524,529 | A | 6/1985 | Schaefer et al. |
| 4,535,553 | A | 8/1985 | Derderian et al. |
| 4,536,974 | A | 8/1985 | Cohen |
| 4,551,930 | A | 11/1985 | Graham et al. |
| 4,562,651 | A | 1/1986 | Frederick et al. |
| 4,566,206 | A | 1/1986 | Weber |
| 4,592,153 | A | 6/1986 | Jacinto |
| 4,610,099 | A | 9/1986 | Signori et al. |
| 4,611,412 | A | 9/1986 | Cohen |
| 4,616,431 | A | 10/1986 | Dassler et al. |
| 4,617,745 | A | 10/1986 | Batra |
| 4,624,061 | A | 11/1986 | Wezel et al. |
| 4,654,983 | A | 4/1987 | Graham et al. |
| 4,676,010 | A | 6/1987 | Cheskin |
| 4,676,011 | A | 6/1987 | O'Rourke et al. |
| 4,753,021 | A | 6/1988 | Cohen |
| 4,754,559 | A | 7/1988 | Cohen |
| 4,756,095 | A | 7/1988 | Lakic |
| 4,759,136 | A | 7/1988 | Stewart et al. |
| 4,771,554 | A | 9/1988 | Hannemann |
| 4,774,774 | A | 10/1988 | Allen, Jr. |
| 4,798,009 | A | 1/1989 | Colonel et al. |
| 4,843,741 | A | 7/1989 | Yung-Mao et al. |
| 4,864,738 | A | 9/1989 | Horovitz |
| 4,874,640 | A | 10/1989 | Donzis |
| 4,876,053 | A | 10/1989 | Norton et al. |
| 4,881,329 | A | 11/1989 | Crowley |
| 4,894,934 | A | 1/1990 | Illustrato |
| 4,905,383 | A | 3/1990 | Beckett et al. |
| 4,910,884 | A | 3/1990 | Lindh et al. |
| 4,918,841 | A | 4/1990 | Turner et al. |
| 4,934,070 | A | 6/1990 | Mauger et al. |
| 4,947,560 | A | 8/1990 | Fuerst et al. |
| 4,972,611 | A | 11/1990 | Swartz et al. |
| 4,999,931 | A | 3/1991 | Vermeulen et al. |
| 5,014,706 | A | 5/1991 | Philipp et al. |
| 5,048,203 | A | 9/1991 | Kling |
| 5,052,130 | A | 10/1991 | Barry et al. |
| 5,060,401 | A | 10/1991 | Whatley |
| 5,070,629 | A | 12/1991 | Graham et al. |
| D324,940 | S | 3/1992 | Claveria |
| D326,956 | S | 6/1992 | Damianoe et al. |
| 5,131,173 | A | 7/1992 | Anderie et al. |
| 5,138,776 | A | 8/1992 | Levin |
| D330,797 | S | 11/1992 | Lucas |
| D334,174 | S | 3/1993 | Hosogai et al. |
| 5,189,816 | A | 3/1993 | Shibata et al. |
| 5,191,727 | A | 3/1993 | Barry et al. |
| 5,195,254 | A | 3/1993 | Tyng et al. |
| 5,195,256 | A | 3/1993 | Kim et al. |
| D336,561 | S | 6/1993 | Hatfield |
| 5,224,277 | A | 7/1993 | Sang Do |
| D343,272 | S | 1/1994 | James |
| 5,279,051 | A | 1/1994 | Whatley |
| 5,282,325 | A | 2/1994 | Beyl |
| D347,105 | S | 5/1994 | Johnson |
| 5,335,430 | A | 8/1994 | Fiso et al. |
| 5,337,492 | A | 8/1994 | Anderie et al. |
| D350,227 | S | 9/1994 | Kilgore |
| D350,433 | S | 9/1994 | Kilgore |
| 5,343,639 | A | 9/1994 | Kilgore et al. |
| D351,057 | S | 10/1994 | Kilgore |
| 5,353,523 | A | 10/1994 | Kilgore et al. |
| 5,353,526 | A | 10/1994 | Foley et al. |
| 5,353,528 | A | 10/1994 | Demarchi et al. |
| D352,160 | S | 11/1994 | Kilgore |
| 5,367,792 | A | 11/1994 | Richard et al. |
| D354,617 | S | 1/1995 | Kilgore |
| 5,381,608 | A | 1/1995 | Claveria |
| D355,755 | S | 2/1995 | Kilgore |
| 5,396,718 | A | 3/1995 | Schuler et al. |
| 5,440,826 | A | 8/1995 | Whatley |
| 5,461,800 | A | 10/1995 | Luthi et al. |
| 5,469,638 | A | 11/1995 | Crawford, III |
| 5,469,639 | A | 11/1995 | Sessa |
| 5,488,786 | A | 2/1996 | Ratay |
| 5,493,791 | A | 2/1996 | Kramer |
| 5,493,792 | A | 2/1996 | Bates et al. |
| 5,502,901 | A | 4/1996 | Brown |
| 5,511,324 | A | 4/1996 | Smith |
| 5,513,448 | A | 5/1996 | Lyons |
| 5,544,431 | A | 8/1996 | Dixon |
| 5,560,126 | A | 10/1996 | Meschan et al. |
| 5,561,920 | A | 10/1996 | Graham et al. |
| 5,577,334 | A | 11/1996 | Park et al. |
| D376,471 | S | 12/1996 | Kalin et al. |
| 5,596,819 | A | 1/1997 | Goldston et al. |
| 5,598,645 | A | 2/1997 | Kaiser |
| 5,615,497 | A | 4/1997 | Meschan |
| 5,625,964 | A | 5/1997 | Lyden et al. |
| 5,628,128 | A | 5/1997 | Miller et al. |
| 5,644,857 | A | 7/1997 | Ouellette et al. |
| 5,671,552 | A | 9/1997 | Pettibone et al. |
| 5,678,327 | A | 10/1997 | Halberstadt |
| 5,701,685 | A | 12/1997 | Pezza |
| 5,706,589 | A | 1/1998 | Marc |
| 5,713,140 | A | 2/1998 | Baggenstoss |
| 5,718,063 | A | 2/1998 | Yamashita et al. |
| 5,729,916 | A | 3/1998 | Vorobiev et al. |
| 5,743,028 | A | 4/1998 | Lombardino |
| 5,752,329 | A | 5/1998 | Horibata et al. |
| 5,761,831 | A | 6/1998 | Cho et al. |
| 5,771,606 | A | 6/1998 | Litchfield et al. |
| 5,778,560 | A | 7/1998 | Danieli |
| 5,782,014 | A | 7/1998 | Peterson |
| 5,797,198 | A | 8/1998 | Pomerantz |
| 5,797,199 | A | 8/1998 | Miller et al. |
| 5,806,208 | A | 9/1998 | French |
| 5,806,209 | A | 9/1998 | Crowley et al. |
| 5,806,210 | A | 9/1998 | Meschan |
| 5,822,886 | A | 10/1998 | Luthi et al. |
| 5,826,352 | A | 10/1998 | Meschan et al. |
| 5,852,886 | A | 12/1998 | Slepian et al. |
| 5,860,225 | A | 1/1999 | O'Dwyer |
| 5,875,567 | A | 3/1999 | Bayley |
| 5,875,568 | A | 3/1999 | Lennihan, Jr. |
| 5,893,219 | A | 4/1999 | Smith et al. |
| 5,901,467 | A | 5/1999 | Peterson et al. |
| 5,918,384 | A | 7/1999 | Meschan |
| 5,926,974 | A | 7/1999 | Friton |
| 5,930,918 | A | 8/1999 | Healy et al. |
| 5,937,544 | A | 8/1999 | Russell |
| 5,937,545 | A | 8/1999 | Dyer et al. |
| 5,970,628 | A | 10/1999 | Meschan |
| 5,983,529 | A | 11/1999 | Serna |
| 5,987,781 | A | 11/1999 | Pavesi et al. |
| 5,996,253 | A | 12/1999 | Spector |

| | | | | |
|---|---|---|---|---|
| 5,996,260 | A | 12/1999 | MacNeill | |
| 6,006,449 | A | 12/1999 | Orlowski et al. | |
| 6,009,636 | A | 1/2000 | Wallerstein | |
| 6,023,859 | A | 2/2000 | Burke et al. | |
| 6,029,374 | A | 2/2000 | Herr et al. | |
| 6,050,002 | A | 4/2000 | Meschan | |
| 6,055,746 | A | 5/2000 | Lyden et al. | |
| 6,115,942 | A | 9/2000 | Paradis | |
| 6,115,943 | A | 9/2000 | Gyr | |
| 6,115,944 | A | 9/2000 | Lain | |
| 6,115,945 | A | 9/2000 | Ellis, III | |
| 6,119,373 | A | 9/2000 | Gebhard et al. | |
| 6,127,010 | A | 10/2000 | Rudy | |
| D434,549 | S | 12/2000 | Solaroli | |
| 6,195,916 | B1 | 3/2001 | Meschan | |
| 6,199,302 | B1 | 3/2001 | Kayano et al. | |
| 6,199,303 | B1 | 3/2001 | Luthi et al. | |
| 6,237,251 | B1 | 5/2001 | Litchfield et al. | |
| 6,253,466 | B1 | 7/2001 | Harmon-Weiss et al. | |
| 6,282,814 | B1 | 9/2001 | Krafsur et al. | |
| 6,295,741 | B1 | 10/2001 | Kita | |
| 6,295,744 | B1 | 10/2001 | Ellis, III | |
| 6,324,772 | B1 | 12/2001 | Meschan | |
| D453,989 | S | 3/2002 | Cagner | |
| 6,354,020 | B1 | 3/2002 | Kimball et al. | |
| 6,385,864 | B1 | 5/2002 | Sell, Jr. et al. | |
| 6,401,365 | B2 | 6/2002 | Kita et al. | |
| 6,487,796 | B1 | 12/2002 | Avar et al. | |
| 6,516,540 | B2 | 2/2003 | Seydel et al. | |
| 6,519,876 | B1 | 2/2003 | Geer et al. | |
| 6,553,692 | B1 | 4/2003 | Chung | |
| 6,568,102 | B1 | 5/2003 | Healy et al. | |
| 6,598,320 | B2 | 7/2003 | Turner et al. | |
| 6,604,300 | B2 | 8/2003 | Meschan | |
| 6,647,645 | B2 | 11/2003 | Kita | |
| 6,662,471 | B2 | 12/2003 | Meschan | |
| 6,722,058 | B2 | 4/2004 | Lucas et al. | |
| 6,751,891 | B2 | 6/2004 | Lombardino | |
| 6,920,705 | B2 | 7/2005 | Lucas et al. | |
| 7,013,582 | B2 * | 3/2006 | Lucas et al. | 36/28 |
| 7,350,320 | B2 * | 4/2008 | Chandler et al. | 36/28 |
| 7,401,419 | B2 * | 7/2008 | Lucas et al. | 36/28 |
| 2001/0042320 | A1 | 11/2001 | Lindqvist et al. | |
| 2001/0049888 | A1 | 12/2001 | Krafsur et al. | |
| 2002/0007571 | A1 | 1/2002 | Ellis | |
| 2002/0078601 | A1 | 6/2002 | Alfond et al. | |
| 2002/0129516 | A1 | 9/2002 | Lucas et al. | |
| 2002/0189132 | A1 | 12/2002 | Yamamoto | |
| 2003/0000108 | A1 | 1/2003 | Kita | |
| 2003/0000109 | A1 | 1/2003 | Kita | |
| 2003/0046830 | A1 | 3/2003 | Ellis | |
| 2003/0070322 | A1 | 4/2003 | Masseron | |
| 2003/0120353 | A1 | 6/2003 | Christensen | |
| 2003/0121178 | A1 | 7/2003 | Rennex | |
| 2003/0163933 | A1 | 9/2003 | Krafsur et al. | |
| 2003/0172549 | A1 | 9/2003 | Soren | |
| 2003/0188455 | A1 | 10/2003 | Weaver | |
| 2003/0192203 | A1 | 10/2003 | Meschan | |
| 2003/0208926 | A1 | 11/2003 | Ellis | |
| 2003/0217482 | A1 | 11/2003 | Ellis | |
| 2003/0221336 | A1 | 12/2003 | Krstic | |
| 2004/0000074 | A1 | 1/2004 | Auger et al. | |
| 2005/0132607 | A1 | 6/2005 | Dojan et al. | |

FOREIGN PATENT DOCUMENTS

| | | |
|---|---|---|
| DE | 92 10 113 .5 | 11/1992 |
| EP | 0 299 669 | 1/1989 |
| EP | 0 192 820 | 12/1990 |
| EP | 0 359 421 | 8/1994 |
| EP | 0 558 541 | 12/1994 |
| EP | 0 694 264 | 1/1996 |
| EP | 0 714 246 | 6/1996 |
| EP | 0 752 216 | 1/1997 |
| EP | 0 815 757 | 1/1998 |
| EP | 0 877 177 | 11/1998 |
| EP | 0 714 611 | 12/1998 |
| EP | 0 916 277 | 5/1999 |
| EP | 1 118 280 | 7/2001 |
| EP | 0 741 529 | 10/2001 |
| JP | S63-2475 | 5/1993 |
| WO | WO-92/08383 | 5/1992 |
| WO | WO-97/13422 | 4/1997 |
| WO | WO-99/04662 | 2/1999 |
| WO | WO-99/29203 | 6/1999 |
| WO | WO-01/17384 | 3/2001 |
| WO | WO-95/20333 | 10/2001 |

* cited by examiner

STRUCTURAL ELEMENT FOR A SHOE SOLE

CROSS-REFERENCE TO RELATED APPLICATION

This application is a continuation of U.S. application Ser. No. 11/396,414, filed on Mar. 31, 2006, which is a continuation of U.S. application Ser. No. 11/346,998, filed on Feb. 3, 2006, which claims priority to and the benefit of, German Patent Application Serial No. 102005006267.9, filed on Feb. 11, 2005, and which is a continuation-in-part of U.S. patent application Ser. No. 10/619,652, filed Jul. 15, 2003, now U.S. Pat. No. 7,013,582, which claims priority to and the benefit of, German Patent Application Serial No. 102349 13.4-26, filed on Jul. 31, 2002, and European Patent Application serial No. 03006874.6, filed on Mar. 28, 2003, the entire disclosures of which are hereby incorporated by reference herein.

TECHNICAL FIELD

The present invention relates to a shoe sole, and more particularly a cushioning element for a shoe sole.

BACKGROUND OF THE INVENTION

In the design of shoes, in particular sports shoes, there are a number of contradicting design goals to be realized. On the one hand, a sports shoe should cushion the loads arising on the body and be capable of permanently resisting the arising forces. On the other hand, a sports shoe should be lightweight in order to hinder, as little as possible, the course of movement of the athlete.

Known sports shoes typically use foamed materials in the sole area to meet the above described requirements. For example, foams made out of ethylene vinyl acetate (EVA) have deformation properties that are well suited for cushioning ground reaction forces. Using different densities and modifying other parameters, the dynamic properties of such foams can be varied over wide ranges to take into account the different loads in different types of sports shoes, or in different parts of a single sports shoe, or both.

Shoe soles with foamed elements, however, have a number of disadvantages. For example, the cushioning properties of an EVA foam depend significantly on the surrounding temperature. Further, the lifetime of a foamed cushioning element is limited. Due to the repeated compressions, the cell structure of the foam degrades over time, such that the sole element loses its original dynamic properties. In the case of running shoes, this effect can occur after approximately 250 km. In addition, manufacturing a shoe with foamed sole elements having different densities is so costly that shoes are often produced only with a continuous midsole made from a homogeneous EVA-foam. The comparatively high weight is a further disadvantage, in particular with hard foams having greater densities. Further, sole elements of foamed materials are difficult to adapt to different shoe sizes since larger designs can result in undesired changes of the dynamic properties.

It has, therefore, been tried for many years to replace known foamed materials with other sole constructions that provide similar or better cushioning properties at a lower weight, where the sole constructions are unaffected by temperature, can be cost-efficiently produced, and have a long lifetime. For example, German Patent Application Nos. DE 41 14 551 A1, DE 40 35 416 A1, DE 102 34 913 A1, and DE 38 10 930 A1, German Utility Model No. DE 210 113 U, and European Patent No. EP 0 741 529 B1, the entire disclosures of which are hereby incorporated herein by reference, disclose constructions of this type. The foam-free sole designs of the prior art, however, have until now not gained acceptance. One reason is that the excellent cushioning properties of EVA foams have not been sufficiently achieved in these foam-free designs. This applies in particular for the heel area where the ground reaction forces acting on the sole reach their maximum values, which can exceed several times the weight of an athlete.

It is, therefore, an object of the present invention to provide a shoe sole that can be cost-efficiently manufactured and provide good cushioning properties in a heel area without using foamed materials so that, if desired, the use of a foamed material is no longer necessary.

SUMMARY OF THE INVENTION

The present invention includes a shoe sole with a structural heel part. The heel part includes a heel cup or a heel rim having a shape that substantially corresponds to the shape of a heel of a foot. The heel part further includes a plurality of side walls arranged below the heel cup or the heel rim and at least one tension element interconnecting at least one of the side walls with another side wall or with the heel cup or the heel rim. The load of the first ground contact of a step cycle is effectively cushioned not only by the elastically bending stiffness of the side walls, but also by the elastic stretchability of the tension element, which acts against a bending of the side walls.

With the aforementioned components provided as a single piece of unitary construction, a high degree of structural stability is obtained and the heel is securely guided during a deformation movement of the heel part. Accordingly, there is a controlled cushioning movement so that injuries in the foot or the knee resulting from extensive pronation or supination are avoided. Furthermore, a single piece construction in accordance with one embodiment of the invention facilitates a very cost-efficient manufacture, for example by injection molding a single component using one or more suitable plastic materials. Tests have shown that a heel part in accordance with the invention has a lifetime of up to four times longer than heel constructions made from foamed cushioning elements. Furthermore, changing the material properties of the tension element facilitates an easy modification of the dynamic response properties of the heel part to ground reaction forces. The requirements of different kinds of sports or of special requirements of certain users can, therefore, be easily complied with by means of a shoe sole in accordance with the invention. This is particularly true for the production of the single piece component by injection molding, since only a single injection molding mold has to be used for shoe soles with different properties.

In one aspect, the invention relates to a sole for an article of footwear, where the sole includes a heel part. The heel part includes a heel cup having a shape that corresponds substantially to a heel of a foot, a plurality of side walls arranged below the heel cup, and at least one tension element interconnecting at least one side wall with at least one of another side wall and the heel cup. The plurality of side walls can include a rear side wall and at least one other side wall that form an aperture therebetween. The heel cup, the plurality of side walls, and the at least one tension element can be integrally made as a single piece.

In another aspect, the invention relates to an article of footwear including an upper and a sole. The sole includes a heel part. The heel part includes a heel cup having a shape that corresponds substantially to a heel of a foot, a plurality of side walls arranged below the heel cup, and at least one tension element interconnecting at least one side wall with at least one of another side wall and the heel cup. The plurality of side walls can include a rear side wall and at least one other side wall forming an aperture therebetween. The heel cup, the plurality of side walls, and the at least one tension element can be integrally made as a single piece. The sole can include a midsole and an outsole, and the heel part can form a portion of the midsole and/or the outsole.

In various embodiments of the foregoing aspects of the invention, the heel part includes side walls interconnected by the tension element. At least one of the side walls defines one or more apertures therethrough. The size and the arrangement of the aperture(s) can influence the cushioning properties of the heel part during a first ground contact. Besides being an adaptation of the cushioning properties, weight can be reduced. The exact arrangement of the apertures and the design of the side walls and of the other elements of the heel part can be optimized, for example, with a finite-element model. In addition, the heel part can define one or more apertures therethrough, the size and arrangement of which can be selected to suit a particular application. In one embodiment, the heel part is a heel rim including a generally centrally located aperture. Additionally, a skin can at least partially cover or span any of the apertures. The skin can be used to keep dirt, moisture, and the like out of the cavities formed within the heel part and does not impact the structural response of the side walls. The side walls continue to function structurally as separate independent walls.

In one embodiment, the heel part includes a lateral side wall and a medial side wall that are interconnected by the tension element. As a result, a pressure load on the two side walls from above is transformed into a tension load on the tension element. Alternatively or additionally, the tension element can interconnect all of the side walls, including the rear wall. The at least one side wall can include an outwardly directed curvature. The tension element can engage at least two of the plurality of side walls substantially at a central region of the respective side walls. The tension element can extend below the heel cup and be connected to a lower surface of the heel cup at a central region thereof. This additional connection further increases the stability of the single piece heel part.

Further, the heel part can include a substantially horizontal ground surface that interconnects the lower edges of at least two of the plurality of side walls. In one embodiment, an outer perimeter of the horizontal ground surface extends beyond lower edges of the side walls. The horizontal ground surface is generally planar; however, the ground surface can be curved or angled to suit a particular application. For example, the horizontal ground surface can be angled about its outside perimeter or can be grooved along its central region to interact with other components. Additionally, the heel part can include at least one reinforcing element. In one embodiment, the at least one reinforcing element extends in an inclined direction from the horizontal ground surface to at least one of the plurality of the side walls. The at least one reinforcing element can extend from a central region of the horizontal ground surface to at least one of the plurality of side walls. In various embodiments, the at least one reinforcing element and the tension element substantially coterminate at the side wall at, for example, a central region thereof. In one embodiment, the heel part has a symmetrical arrangement of two reinforcing elements extending from a central region of the ground surface to the side walls, wherein the two reinforcing elements each terminate in the same, or substantially the same, area as the tension element. As a result, the single piece heel part has an overall framework-like structure leading to a high stability under compression and shearing movements of the sole.

Furthermore, at least one of the heel cup, the side walls, the tension element, and the reinforcing elements has a different thickness than at least one of the heel cup, the side walls, the tension element, and the reinforcing elements. In one embodiment, a thickness of at least one of the heel cup, the side walls, the tension element, and the reinforcing elements varies within at least one of the heel cup, the side walls, the tension element, and the reinforcing elements. For example, the cushioning behavior of the heel part may be further adapted by side walls of different thicknesses and by changing the curvature of the side walls. Additionally or alternatively, the use of different materials, for example materials of different hardnesses, can be used to further adapt the cushioning properties of the heel part. The heel part can be manufactured by injection molding a thermoplastic urethane or similar material. In one embodiment, the heel part can be manufactured by multi-component injection molding at least two different materials. The heel part can be substantially or completely free from foamed materials, insofar as no purposeful foaming of the material(s) used in forming the heel part is carried out by, for example, the introduction of a chemical or physical process to cause the material to foam. Alternatively, foamed materials can be disposed within the various cavities defined within the heel part by the side walls, tension elements, and reinforcing elements, to improve the cushioning properties of the heel part.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

In the following, embodiments of the sole and the heel part in accordance with the invention are further described with reference to a shoe sole for a sports shoe. It is, however, to be understood that the present invention can also be used for other types of shoes that are intended to have good cushioning properties, a low weight, and a long lifetime. In addition, the present invention can also be used in other areas of a sole, instead of or in addition to the heel area.

Figure 1A:
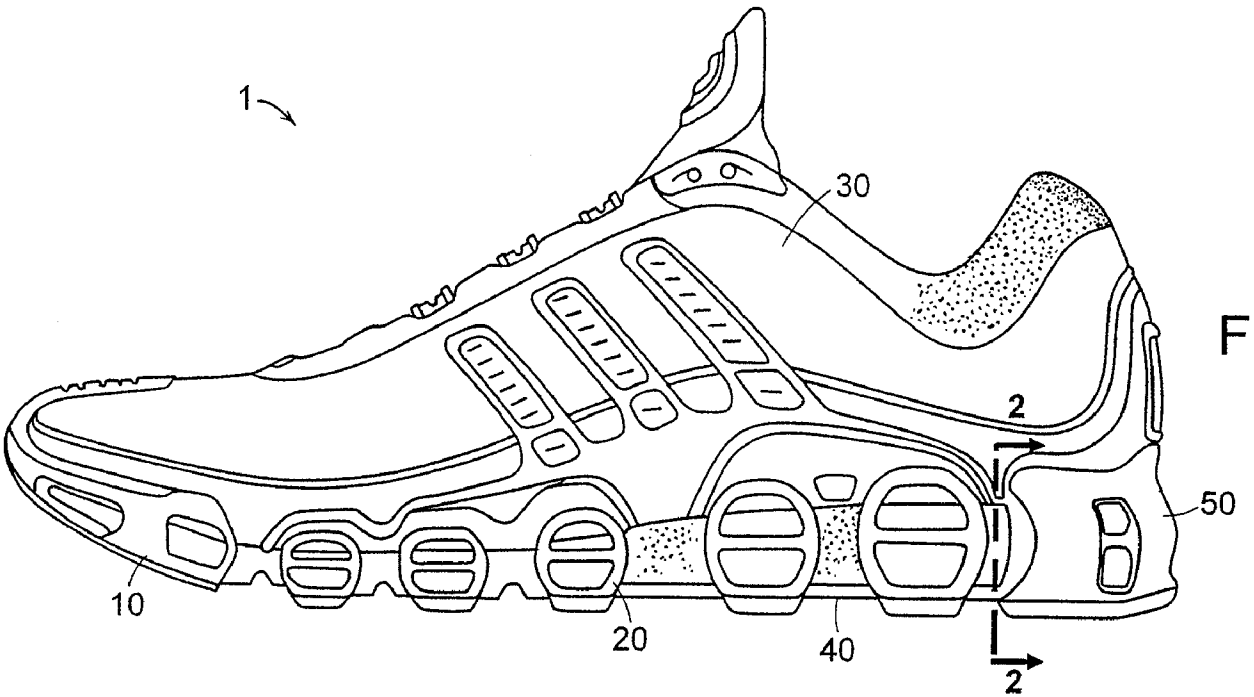
FIG. 1A is a schematic side view of a shoe including a sole in accordance with one embodiment of the invention.

FIG. 1A shows a side view of a shoe 1 including a sole 10 that is substantially free of foamed cushioning elements and an upper 30. As can be seen, individual cushioning elements 20 of a honeycomb-like shape are arranged along a length of the sole 10 providing the cushioning and guidance functions that are in common sports shoes provided by a foamed EVA midsole. The upper sides of the individual cushioning elements 20 can be attached to either the lower side of the upper 30 or to a load distribution plate (or other transitional plate) that is arranged between the shoe upper 30 and the cushioning elements 20, for example by gluing, welding, or other mechanical or chemical means known to a person of skill in the art. Alternatively, the individual cushioning elements 20 could be manufactured integrally with, for example, the load distribution plate.

The lower sides of the individual cushioning elements 20 are in a similar manner connected to a continuous outsole 40. Instead of the continuous outsole 40 shown in FIG. 1B, each cushioning element 20 could have a separate outsole section or sections for engaging the ground. In one embodiment, the cushioning elements 20 are structural elements, as disclosed in U.S. Patent Publication No. 2004/0049946 A1, the entire disclosure of which is hereby incorporated herein by reference.

Figure 1B:
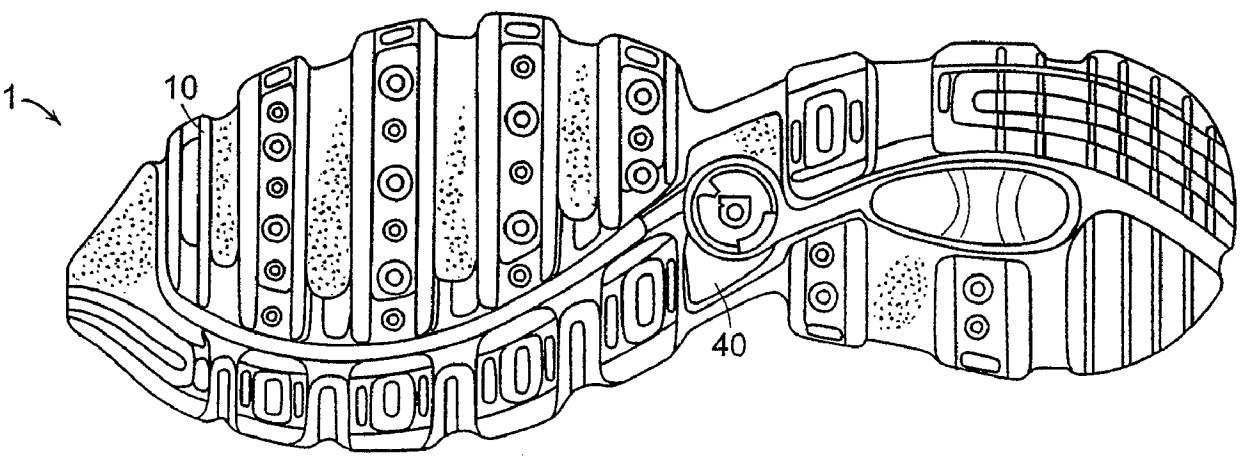
FIG. 1B is a schematic bottom view of the shoe sole of FIG. 1A.

The sole construction presented in FIGS. 1A and 1B is subjected to the greatest loads during the first ground contact of each step cycle. The majority of runners contact the ground at first with the heel before rolling off via the midfoot section and pushing off with the forefoot part. A heel part 50 of the foam-free sole 10 of FIG. 1A is, therefore, subjected to the greatest loads.

FIGS. 2-6 show detailed representations of one embodiment of the heel part 50. The heel part 50, as it is described in detail in the following, can be used independently from the other structural designs of the shoe sole 10. It may, for example, be used in shoe soles wherein one or more commonly foamed cushioning elements are used, instead of or in combination with the above discussed cushioning elements 20.

Figure 2:
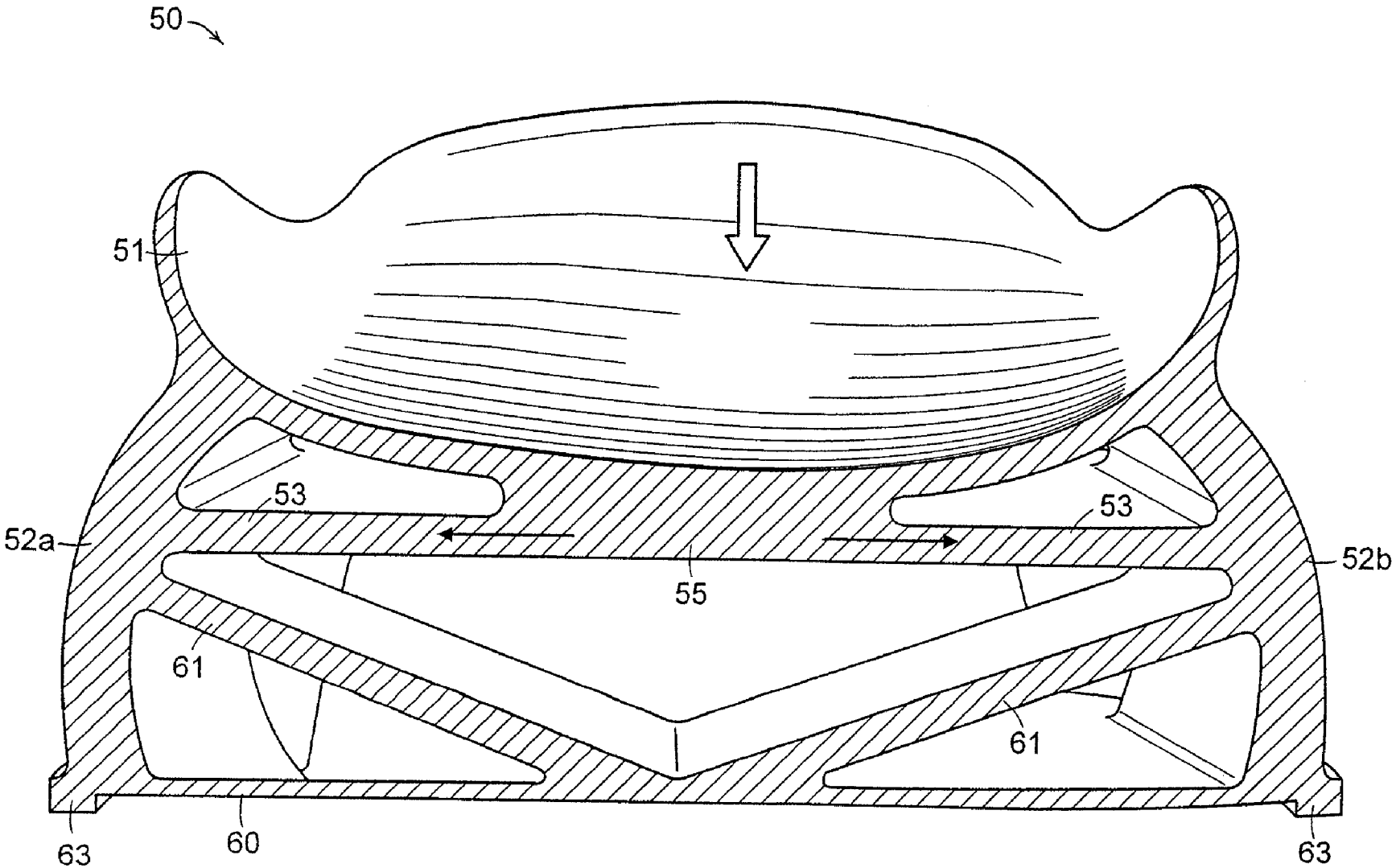
FIG. 2 is a schematic front view of a heel part in accordance with one embodiment of the invention for use in the shoe sole of FIGS. 1A and 1B, orientated as shown by line 2-2 in FIG. 1A.

As shown in FIG. 2, the heel part 50 includes two substantially vertically extending sidewalls 52 arranged below an anatomically shaped heel cup 51 that is adapted to encompasses a wearer's heel from below, on the medial side, the lateral side, and the rear. One of the side walls 52 extends on the medial side and the other on the lateral side. In one embodiment, the sidewalls are separated by an aperture 72 (see FIG. 3) disposed therebetween that allows the side walls to function separately. In a particular embodiment, the sidewalls 52 have an initial unloaded configuration within the heel part 50 of being slightly curved to the outside, i.e., they are convex when viewed externally. This curvature is further increased, when the overall heel part 50 is compressed. The heel part 50 also includes reinforcing elements 61 described in greater detail hereinbelow.

A tension element 53 having an approximately horizontal surface is arranged below the heel cup 51 and extends from substantially a center region of the medial side wall 52*a* to substantially a center region of the lateral side wall 52*b*. Under a load on the heel part 50 (vertical arrow in FIG. 2), the tension element 53 is subjected to tension (horizontal arrows in FIG. 2) when the two side walls 52 are curved in an outward direction. As a result, the dynamic response properties of the heel part 50, for example during ground contact with the sole 10, is in a first approximation determined by the combination of the bending stiffness of the side walls 52 and the stretchability of the tension element 53. For example, a thicker tension element 53 and/or a tension element 53, which due to the material used requires a greater force for stretching, lead to harder or stiffer cushioning properties of the heel part 50.

Both the tension element 53 and the reinforcing elements 61 (explained further below), as well as the side walls 52 and further constructive components of the heel part 50 are provided in one embodiment as generally planar elements. Such a design, however, is not required. On the contrary, it is well within the scope of the invention to provide one or more of the elements in another design, for example, as a tension strut or the like.

In the embodiment depicted, the tension element 53 is interconnected with each side wall 52 at approximately a central point of the side wall's curvature. Without the tension element 53, the maximum bulging to the exterior would occur here during loading of the heel part 50, so that the tension element 53 is most effective here. The thickness of the planar tension element 53, which is generally within a range of about 5 mm to about 10 mm, gradually increases towards the side walls. In one embodiment, the thickness increases by approximately 5% to 15%. In one embodiment, the tension element 53 has the smallest thickness in its center region between the two side walls. Increasing the thickness of the tension element 53 at the interconnections between the tension element 53 and the side walls 52 reduces the danger of material failure at these locations.

In the embodiment shown in FIG. 2, the tension element 53 and a lower surface of the heel cup 51 are optionally interconnected in a central region 55. This interconnection improves the stability of the overall heel part 50. In particular, in the case of shearing loads on the heel part 50, as they occur during sudden changes of the running direction (for example in sports like basketball), an interconnection of the heel cup 51 and the tension element 53 is found to be advantageous. Another embodiment, which is in particular suitable for a basketball shoe, is further described hereinbelow with reference to FIGS. 11A and 11B.

Figure 3:
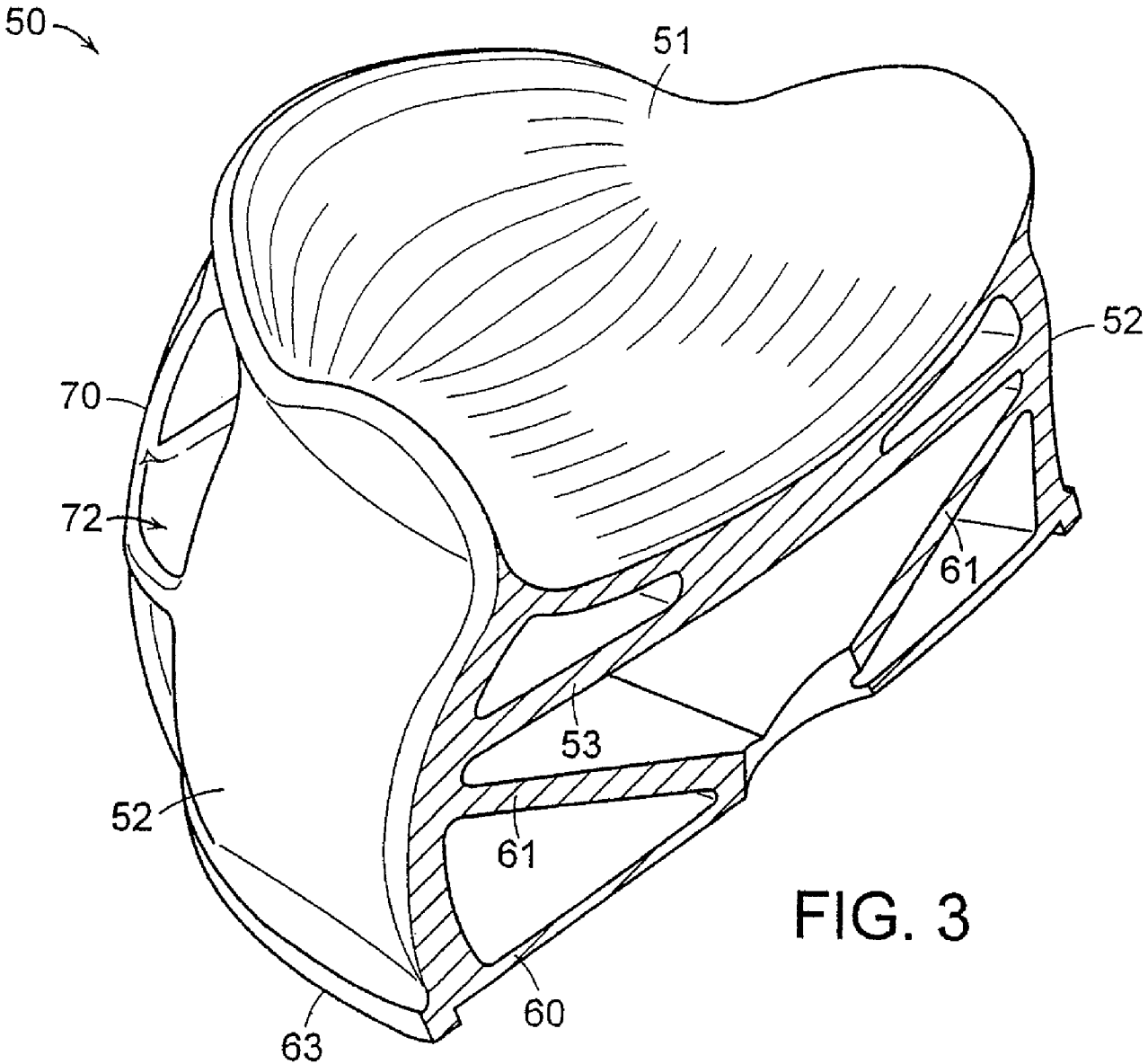
FIG. 3 is a schematic front perspective view of the heel part of FIG. 2.

FIGS. 2 and 3 disclose additional surfaces that form a framework below the heel cup 51 for stabilizing the heel part 50. A ground surface 60 interconnects lower edges of the medial side wall 52*a* and the lateral side wall 52*b*. Together with the heel cup 51 at the upper edges and the tension element 53 in the center, the ground surface 60 defines the configuration of the medial and the lateral side walls 52. Thus, it additionally contributes to avoiding a collapse of the heel part 50 in the case of peak loads, such as when landing after a high leap. Furthermore, additional sole layers can be attached to the ground surface 60, for example the outsole layer 40 shown in FIGS. 1A and 1B, or additional cushioning layers. Such further cushioning layers may be arranged alternatively or additionally above or within the heel part 50.

The ground surface 60 of the single piece heel part 50 may itself function as an outsole and include a suitable profile, such as a tread. This may be desirable if a particularly lightweight shoe is to be provided. As shown in FIGS. 2 and 3, an outer perimeter 63 of the ground surface 60 exceeds the lower edges of the side walls 52. Such an arrangement may be desirable if, for example, a wider region for ground contact is to be provided for a comparatively narrow shoe.

In addition, FIGS. 2 and 3 depict two reinforcing elements 61 extending from approximately the center of the ground surface 60 in an outward and inclined direction to the side walls 52. The reinforcing elements 61 engage the side walls 52 directly below the tension element 53. The reinforcing elements 61 thereby additionally stabilize the deformation of the side walls 52 under a pressure load on the heel part 50. Studies with finite-element-analysis have in addition shown that the reinforcing elements 61 significantly stabilize the heel part 50 when it is subjected to the above mentioned shear loads.

Figure 4:
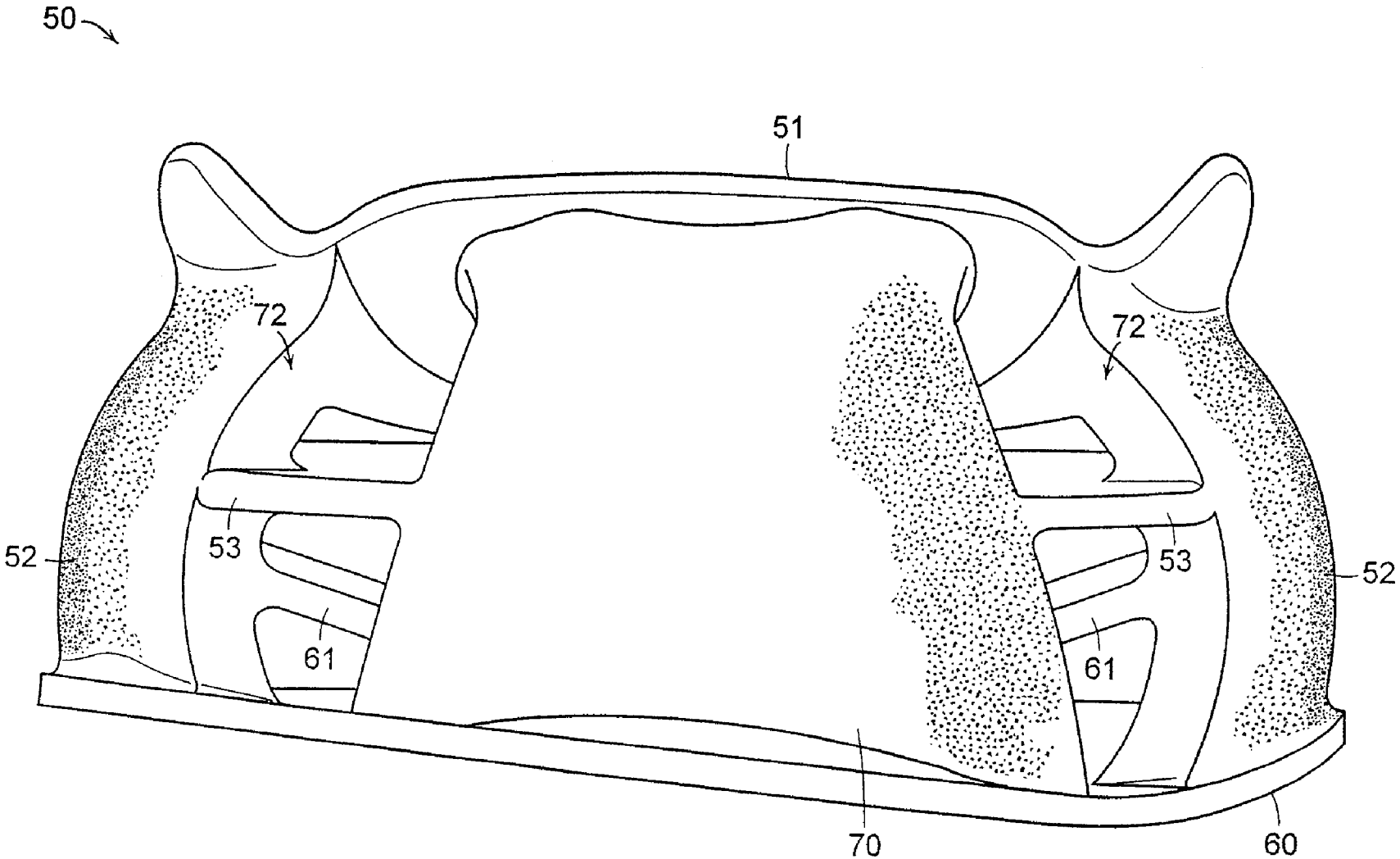
FIG. 4 is a schematic rear view of the heel part of FIG. 2.
Figure 5:
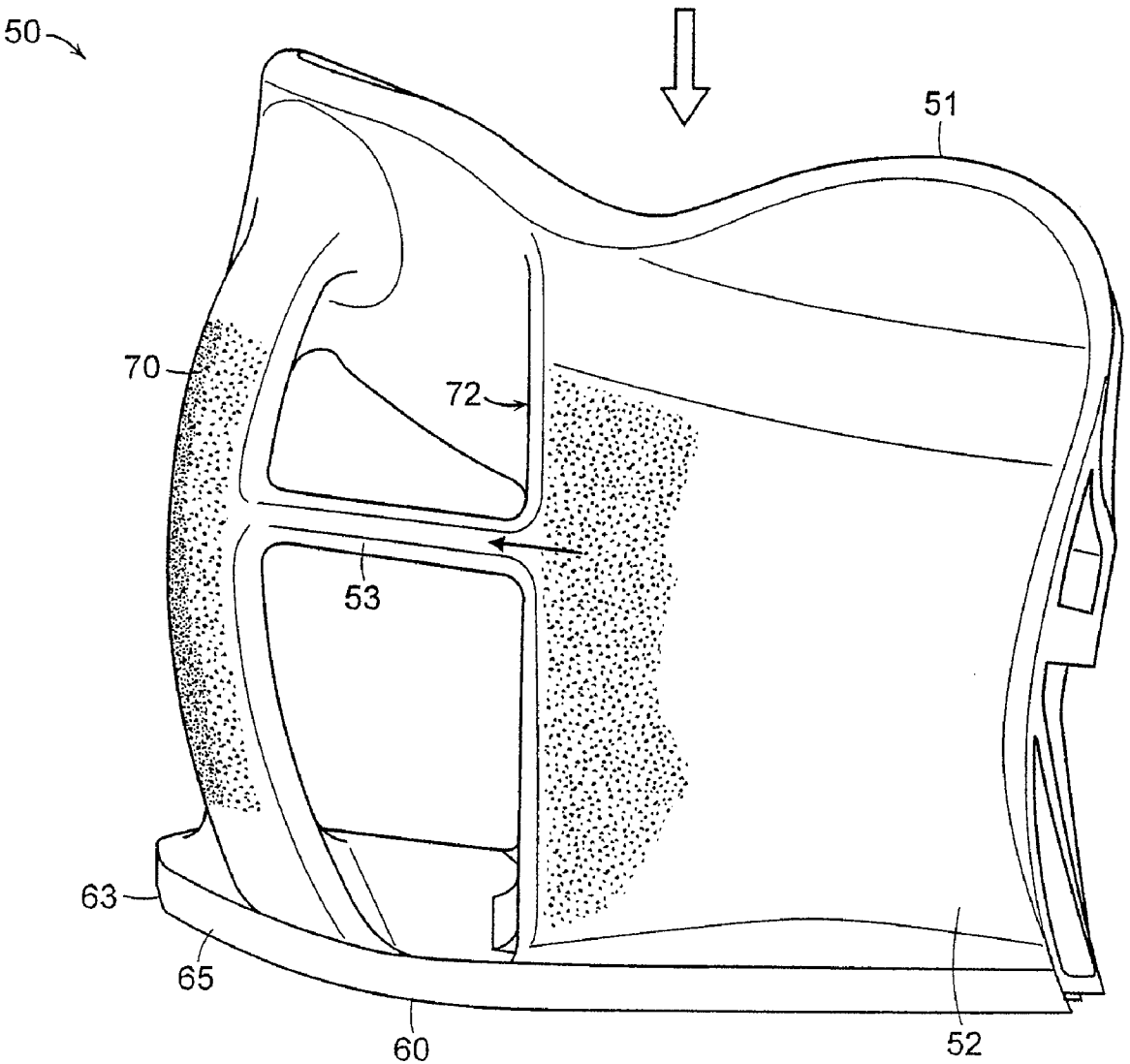
FIG. 5 is a schematic side view of the heel part of FIG. 2.
Figure 6:
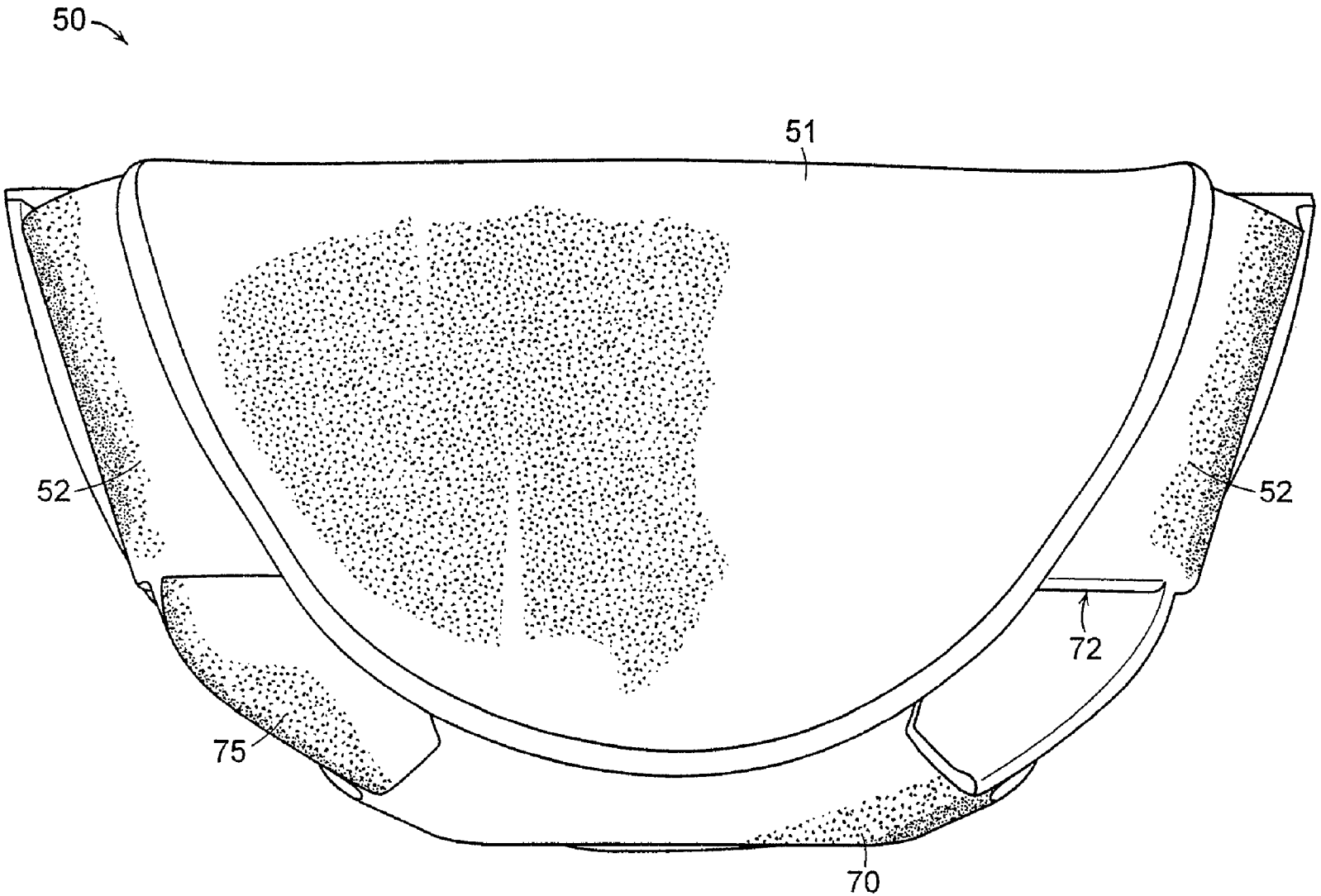
FIG. 6 is a schematic top view of the heel part of FIG. 2.

FIGS. 4-6 show the rear, side, and top of the heel part 50. As can be seen, there is a substantially vertical side wall located in a rear area of the heel part, i.e., a rear wall 70, that forms the rear portion of the heel part 50 and, thereby, of the shoe sole 10. As in the case of the other side walls 52, the rear wall 70 is outwardly curved when the heel part 50 is compressed. Accordingly, the tension element 53 is also connected to the rear wall 70 so that a further curvature of the rear wall 70 in the case of a load from above (vertical arrow in FIG. 5) leads to a rearwardly directed elongation of the tension element 53 (horizontal arrow in FIG. 5). In one embodiment, the tension element 53 engages the rear wall 70 substantially in a central region thereof. Although in the embodiment of FIGS. 2 to 6 the reinforcing elements 61 are not shown connected to the rear wall 70, it is contemplated and within the scope of the invention to extend the reinforcing elements 61 to the rear wall 70 in a similar manner as to the side walls 52 to further reinforce the heel part 50.

Additionally, as shown in FIG. 5, the rearmost section 65 of the ground surface 60 is slightly upwardly angled to facilitate the ground contact and a smooth rolling-off. Also, the aforementioned apertures 72 are clearly shown in FIGS. 4-6, along with a skin 75 covering one of the apertures 73 (see FIG. 6).

Figure 7A:
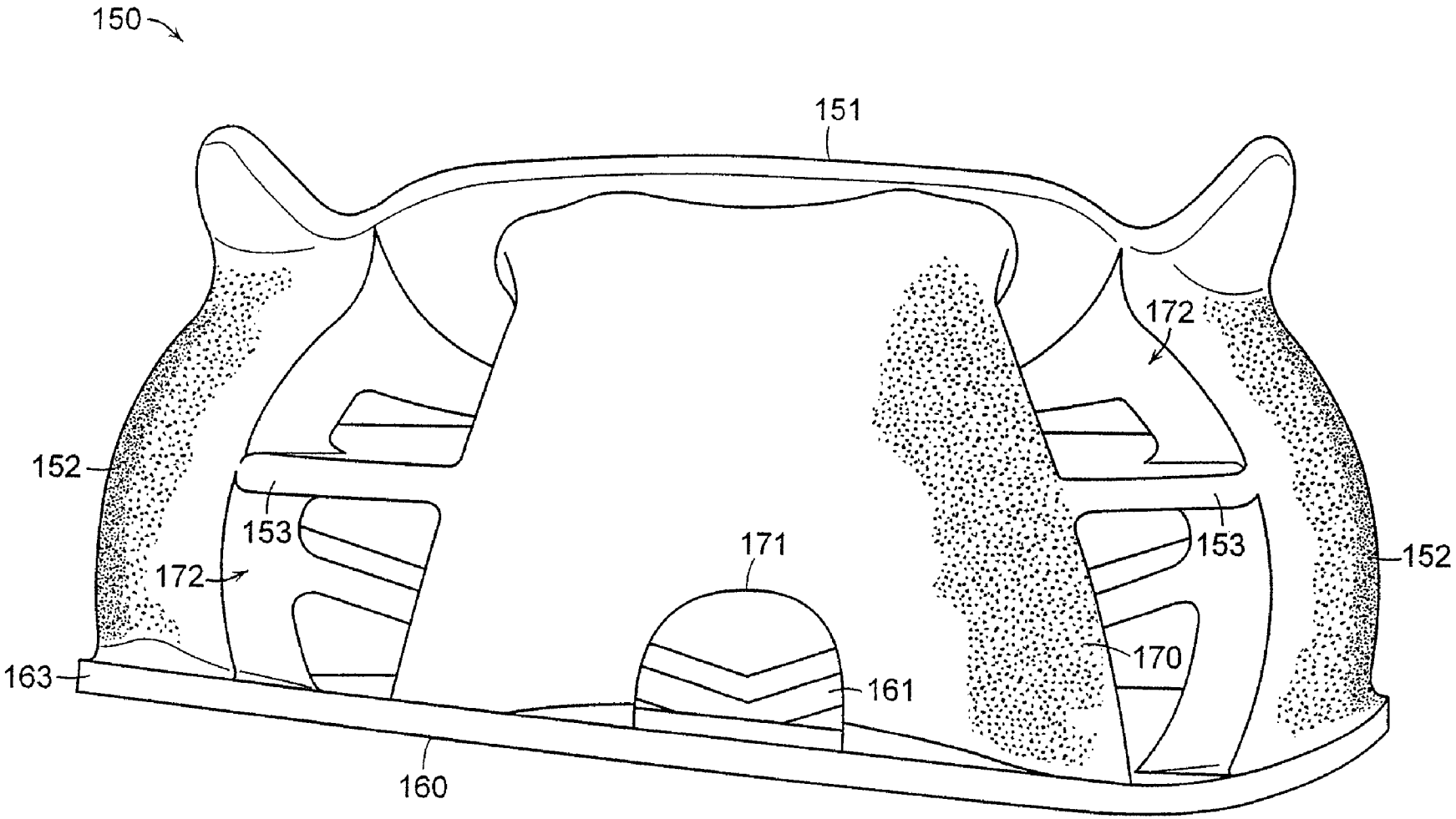
FIG. 7A is a schematic rear view of an alternative embodiment of a heel part in accordance with the invention.

FIGS. 7 and 8 present modifications of the embodiment discussed in detail above. In the following, certain differences of these embodiments compared to the heel part of FIGS. 2 to 6 are explained. FIG. 7A shows a heel part 150 with an aperture 171 arranged in the rear wall 170. The shape and the size of the aperture 171 can influence the stiffness of the heel part 150 during ground contact and may vary to suit a particular application. This is illustrated in FIGS. 9 and 10.

Figure 9:
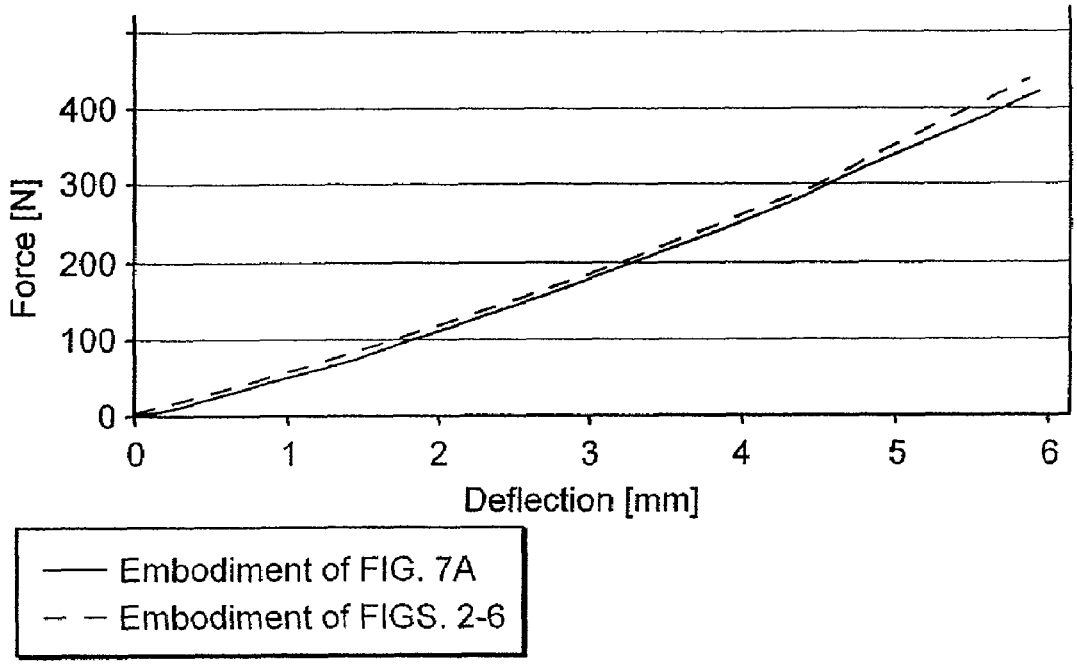
FIG. 9 is a graph comparing the vertical deformation properties of the embodiments of the heel parts shown in FIG. 2 and FIG. 7A.

FIG. 9 shows the force (Y-axis) that is necessary to vertically compress the heel part 50, 150 by a certain distance using an Instron® measuring apparatus, available from Instron Industrial Products of Grove City, Pa. The Instron® measuring apparatus is a universal test device known to the skilled person, for testing material properties under tension, compression, flexure, friction, etc. Both embodiments of the heel part 50, 150 show an almost linear graph, i.e., the cushioning properties are smooth and even at a high deflection of up to about 6 mm, the heel part 50, 150 does not collapse. A more detailed inspection shows that the heel part 150 of FIG. 7A has due to the aperture 171*a* slightly lower stiffness, i.e., it leads at the same deflection to a slightly smaller restoring force.

Figure 10:
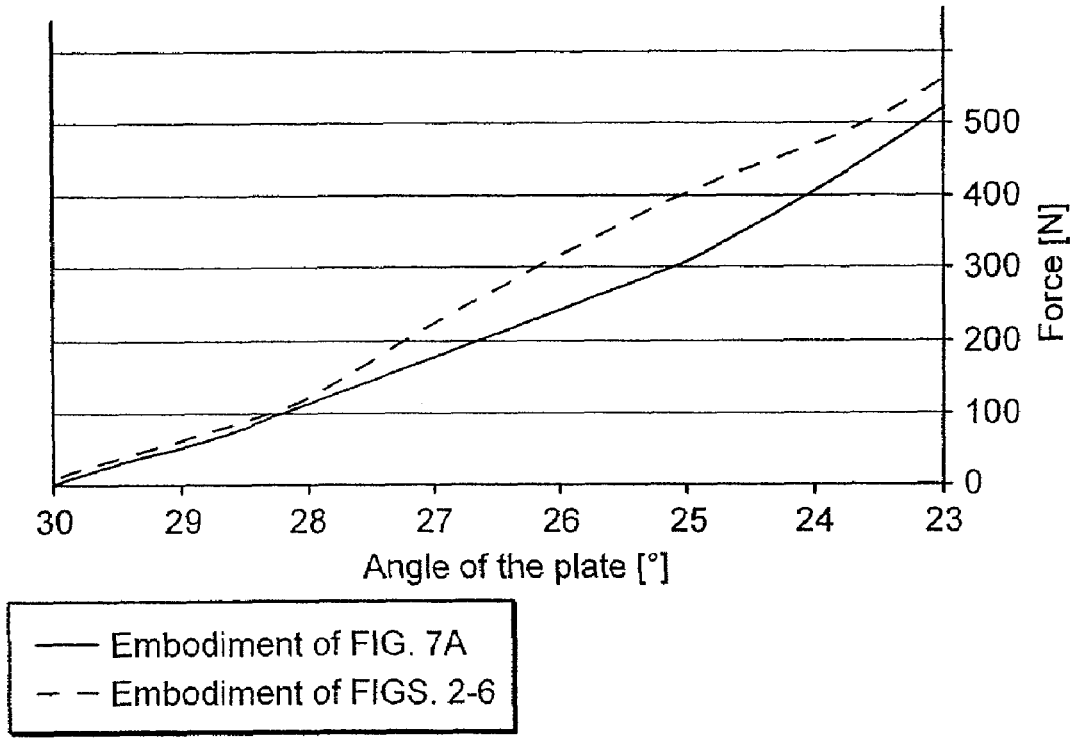
FIG. 10 is a graph comparing the deformation properties of the embodiments of the heel parts shown in FIG. 2 and FIG. 7A under a load on the contact edge of the heel part.

A similar result is obtained by an angular load test, the results of which are shown in FIG. 10. In this test, a plate contacts the rear edge of the heel part 50, 150 at first under an angle of 30° with respect to the plane of the sole. Subsequently, the restoring force of the heel part 50, 150 is measured when the angle is reduced and the heel part 50, 150 remains fixed with respect to the point of rotation of the plate. This test arrangement reflects in a more realistic manner the situation during ground contact and rolling-off, than an exclusively vertical load. Also here, the heel part 150 with the aperture 171 in the rear wall 170 provides a slightly lower restoring force than the heel part 50 of FIGS. 2-6. For both embodiments, the graph is almost linear over a wide range (from about 30° to about 23°).

Figure 7B:
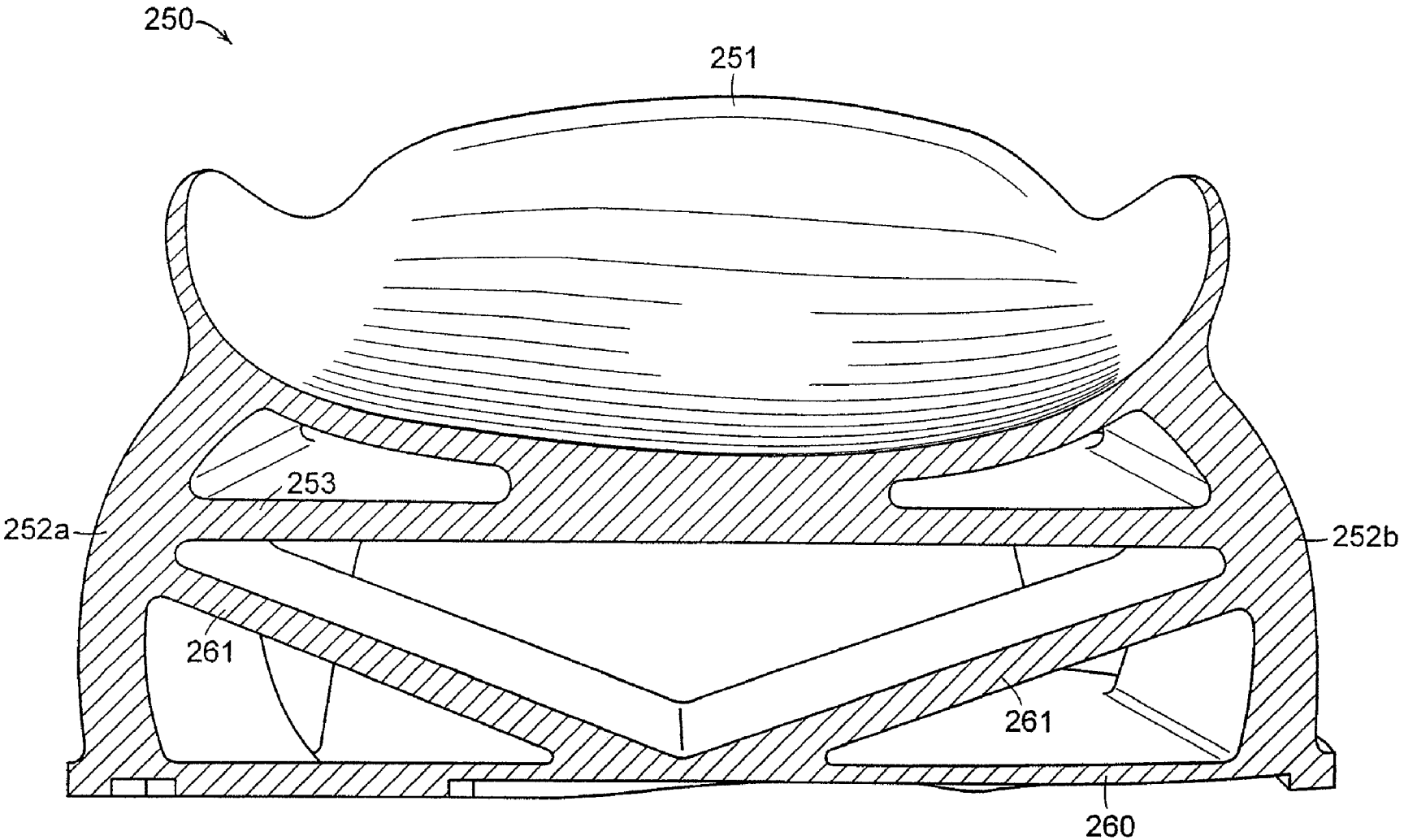
FIG. 7B is a schematic front view of an alternative embodiment of a heel part in accordance with the invention.

Whereas the embodiments of the FIGS. 2-6 are substantially symmetrical with respect to a longitudinal axis of the shoe sole, FIG. 7B displays a front view of an alternative embodiment of a heel part 250, wherein one side wall 252*b* is higher than the other side wall 252*a*. Depending on whether the higher side wall 252*b* is arranged on the medial side or the lateral side of the heel part 250, the wearer's foot can be brought into a certain orientation during ground contact to, for example, counteract pronation or supination. Additionally or alternatively, the thickness of an individual wall 252, or any other element, can be varied between the various elements and/or within a particular element to modify a structural response of the element and heel part 250.

Figure 8A:
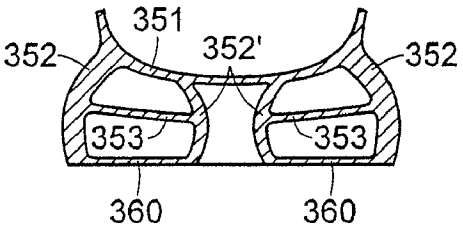
FIGS. 8A-8H are pictorial representations of alternative embodiments of a heel part in accordance with the invention.

FIGS. 8A-8H disclose pictorially the front views of a plurality of alternative embodiments of the present invention, wherein the above discussed elements are modified. In FIG. 8A, two separate structures are arranged below the heel cup 351 for the medial and the lateral sides. As a result, two additional central side walls 352' are obtained in addition to the outer lateral side wall 352 and the outer medial side wall 352, as well as independent medial and lateral tension elements 353. The ground surface 360 is also divided into two parts in this embodiment.

Figure 8B:
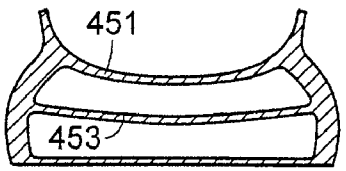
Figure 8C:
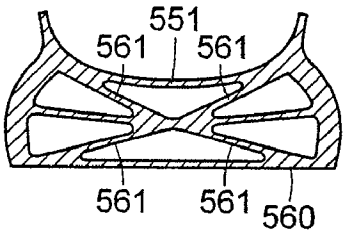

FIG. 8B shows a simplified embodiment without any reinforcing elements and without an interconnection between the heel cup 451 and the tension element 453. Such an arrangement has a lower weight and is softer than the above described embodiments; however, it has a lower stability against shear loads. The embodiment of FIG. 8C, by contrast, is particularly stable, since four reinforcing elements 561 are provided, which diagonally bridge the cavity between the heel cup 551 and the ground surface 560.

Figure 8D:
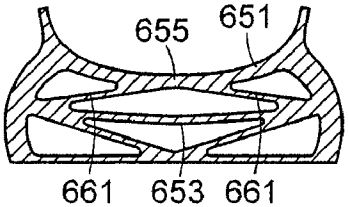
Figure 8E:
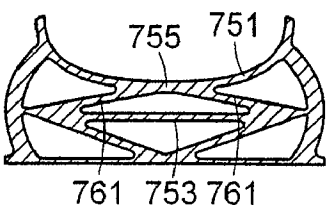
Figure 8F:
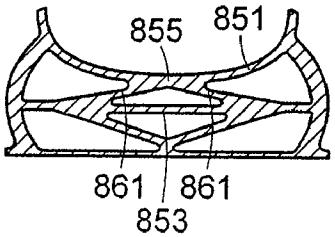

The embodiments of FIGS. 8D-8F are similar to the above described embodiments of FIGS. 2-6; however, additional reinforcing elements 661, 761, 861 are arranged extending between the tension elements 653, 753, 853 and the central regions 655, 755, 855 of the heel cups 651, 751, 851, which itself is not directly connected to the tension elements 653, 753, 853. The three embodiments differ by the connections of the reinforcing elements 661, 761, 861 to the tension elements 653, 753, 853. Whereas in the embodiment of FIG. 8D, the connection points are at the lateral and medial edges of the tension element 653, they are, in the embodiments of FIG. 8E and in particular FIG. 8F, moved further to the center of the tension elements 753, 853.

Figure 8G:
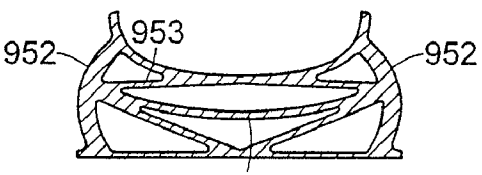
Figure 8H:
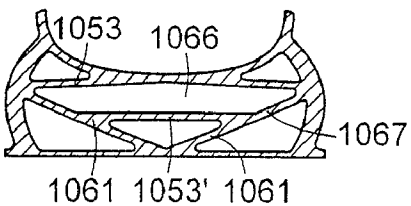

The embodiments of FIGS. 8G and 8H include a second tension element 953', 1053' below the first tension element 953. 1053. Whereas the first tension element 953, 1053 is in these embodiments slightly upwardly curved, the second tension element 953' has a downwardly directed curvature. In the embodiment of FIG. 8G, the second tension element 953' bridges the overall distance between the medial and lateral side walls 952 in a similar manner to the first tension element 953. In the embodiment of FIG. 8H, the second tension element 1053' extends substantially between mid-points of the reinforcing elements 1061. In addition, the embodiment of FIG. 8H includes an additional cushioning element 1066 disposed within a cavity 1067 formed by the tension and reinforcing elements 1053, 1061, as described in greater detail hereinbelow.

Figure 11A:
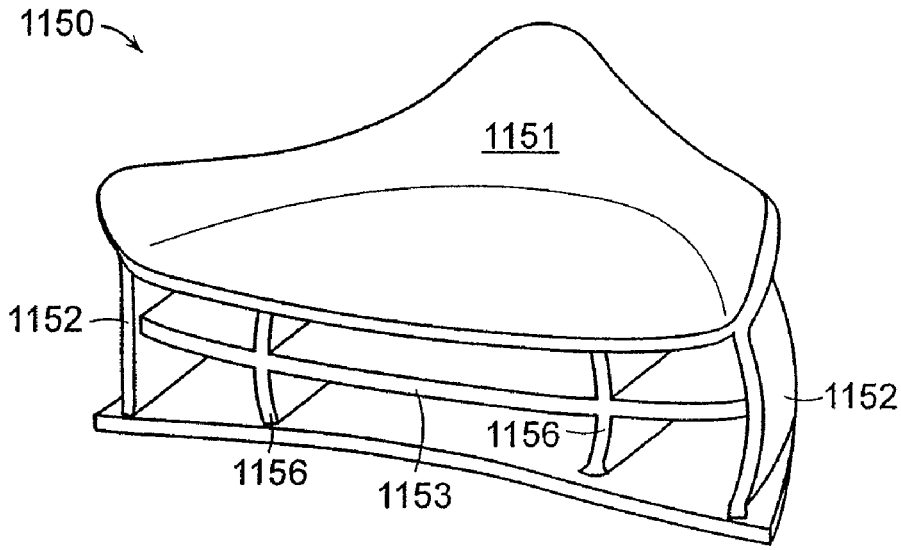
FIG. 11A is a schematic front view of an alternative embodiment of a heel part in accordance with the invention for use in a basketball shoe.
Figure 11B:
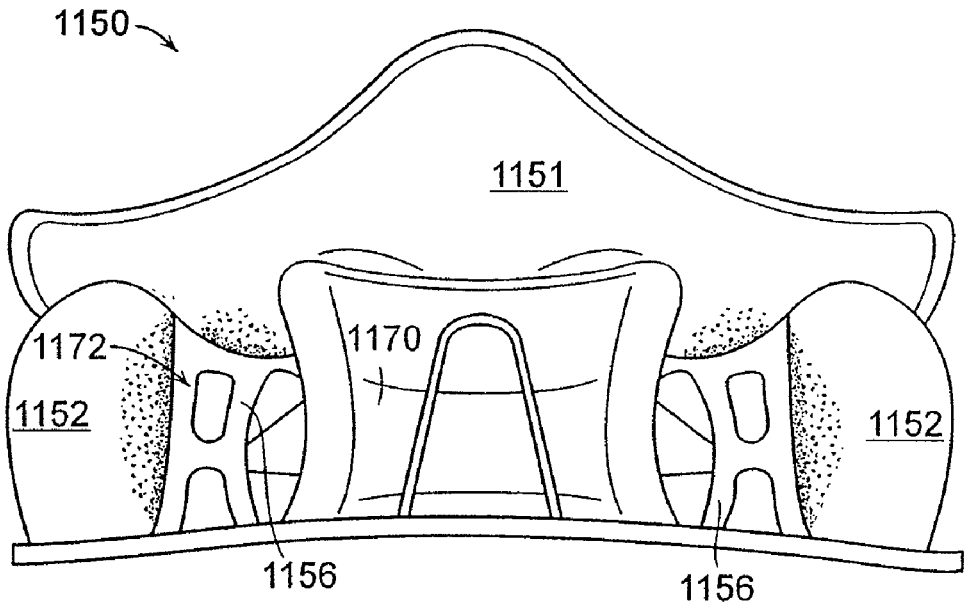
FIG. 11B is a schematic rear view of the heel part of FIG. 11A.

FIGS. 11A and 11B depict another alternative embodiment of a heel part 1150 in accordance with the invention, suitable for use in a basketball shoe. As shown in FIG. 11A, two additional inner side walls 1156 are provided to reinforce the construction against the significant compression and shearing loads occurring in basketball. As shown in FIG. 11B, this embodiment includes a continuous rear wall 1170, which, as explained above, also achieves a higher compression stability. On the whole, a particularly stable construction is obtained with a comparatively flat arrangement, which, if required, may be further reinforced by the arrangement of additional inner side walls 1156.

Figure 12:
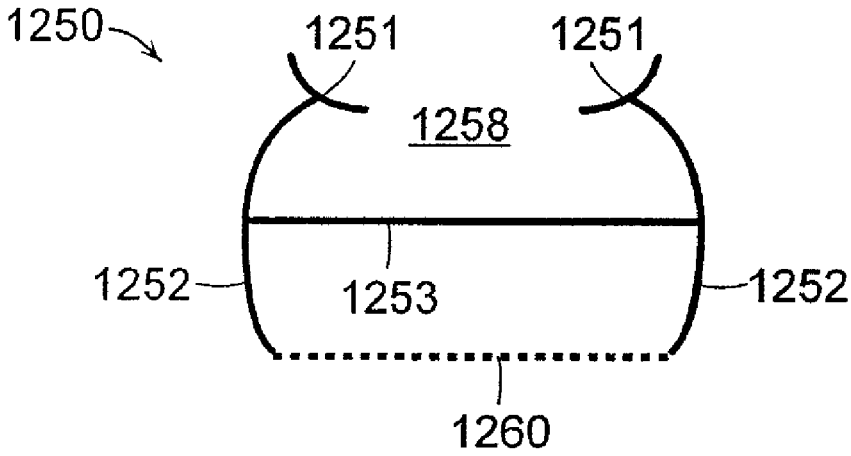
FIG. 12 is a pictorial representation of an alternative embodiment of a heel part in accordance with the invention, where a heel rim is used instead of the heel cup.

Another alternative embodiment of a heel part 1250 is pictorially represented in FIG. 12, in which a heel rim 1251 is included instead of the continuous heel cup 51 depicted in FIGS. 2-6. Like the aforementioned heel cup 51, the heel rim 1251 has an anatomical shape, i.e., it has a curvature that substantially corresponds to the shape of the human heel in order to securely guide the foot during the cushioning movement of the heel part. The heel rim 1251, therefore, encompasses the foot at the medial side, the lateral side, and from the rear. The heel part 1250 depicted includes lateral and medial side walls 1252, a tension element 1253, and an optional ground surface 1260; however, the heel part 1250 could include any of the arrangements of side walls, tension elements, reinforcing elements, and ground surfaces as described herein. In the embodiment shown, the heel part 1251 differs from the aforementioned heel cup 51 by a central aperture or cut-out 1258, which, depending on the embodiment, may be of different sizes and shapes to suit a particular application. This deviation facilitates the arrangement of an additional cushioning element directly below a calcaneus bone of the heel, for example, a foamed material to achieve a particular cushioning characteristic.

Figure 13:
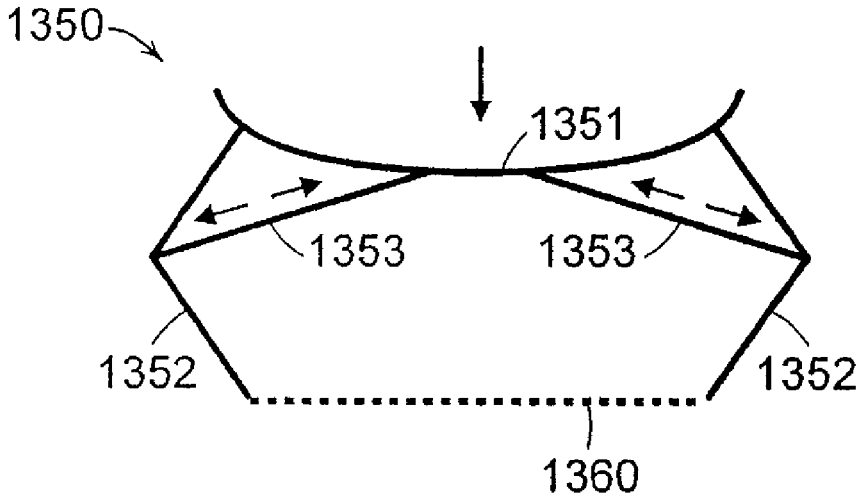
FIG. 13 is a pictorial representation of an alternative embodiment of a heel part in accordance with the invention, with angled side walls and tension elements extending between the side walls and a heel cup.

Yet another alternative embodiment of a heel part 1350 is pictorially represented in FIG. 13. The heel part 1350 includes angled side walls 1352 instead of the slightly bent or curved side walls 52 of the aforementioned embodiments. Additionally, the tension element 1353 in this embodiment does not directly interconnect the two sidewalls 1352, instead two tension elements 1353 each interconnect one side wall 1352 to the heel cup 1351; however, additional tension elements and reinforcing elements could also be included. An optional ground surface 1360 may also be provided in this embodiment.

Furthermore, the plurality of cavities resulting from the various arrangements of the aforementioned elements may also be used for cushioning. For example, the cavities may either be sealed in an airtight manner or additional cushioning elements made from, for example, foamed materials, a gel, or the like arranged inside the cavities (see FIG. 8H).

The size and shape of the heel part and its various elements may vary to suit a particular application. The heel part and elements can have essentially any shape, such as polygonal, arcuate, or combinations thereof. In the present application, the term polygonal is used to denote any shape including at least two line segments, such as rectangles, trapezoids, and triangles, and portions thereof. Examples of arcuate shapes include circles, ellipses, and portions thereof.

Generally, the heel part can be manufactured by, for example, molding or extrusion. Extrusion processes may be used to provide a uniform shape. Insert molding can then be used to provide the desired geometry of open spaces, or the open spaces could be created in the desired locations by a subsequent machining operation. Other manufacturing techniques include melting or bonding. For example, the various elements may be bonded to the heel part with a liquid epoxy or a hot melt adhesive, such as EVA. In addition to adhesive bonding, portions can be solvent bonded, which entails using a solvent to facilitate fusing of the portions to be added. The various components can be separately formed and subsequently attached or the components can be integrally formed by a single step called dual injection, where two or more materials of differing densities are injected simultaneously.

In addition to the geometric arrangement of the framework-like structure below the heel plate, the material selection can also determine the dynamic properties of the heel part. In one embodiment, the integrally interconnected components of the heel are manufactured by injection molding a suitable thermoplastic urethane (TPU). If necessary, certain components, such as the tension element, which are subjected to high tensile loads, can be made from a different plastic material than the rest of the heel part. Using different materials in the single piece heel part can easily be achieved by a suitable injection molding tool with several sprues, or by co-injecting through a single sprue, or by sequentially injecting the two or more plastic materials.

Additionally, the various components can be manufactured from other suitable polymeric material or combination of polymeric materials, either with or without reinforcement. Suitable materials include: polyurethanes; EVA; thermoplastic polyether block amides, such as the Pebax® brand sold by Elf Atochem; thermoplastic polyester elastomers, such as the Hytrel® brand sold by DuPont; thermoplastic elastomers, such as the Santoprene® brand sold by Advanced Elastomer Systems, L.P.; thermoplastic olefin; nylons, such as nylon 12, which may include 10 to 30 percent or more glass fiber reinforcement; silicones; polyethylenes; acetal; and equivalent materials. Reinforcement, if used, may be by inclusion of glass or carbon graphite fibers or para-aramid fibers, such as the Kevlar® brand sold by DuPont, or other similar method. Also, the polymeric materials may be used in combination with other materials, for example natural or synthetic rubber. Other suitable materials will be apparent to those skilled in the art.

Having described certain embodiments of the invention, it will be apparent to those of ordinary skill in the art that other embodiments incorporating the concepts disclosed herein may be used without departing from the spirit and scope of the invention, as there is a wide variety of further combinations of a heel cup, side walls, tension elements, reinforcing elements and ground surfaces that are possible to suit a particular application and may be included in any particular embodiment of a heel part and shoe sole in accordance with the invention. The described embodiments are to be considered in all respects as only illustrative and not restrictive.

What is claimed is:

1. A sole for an article of footwear comprising a heel part, the heel part comprising:

a heel cup having a lower surface and a shape that corresponds substantially to a heel of a foot;

a plurality of side walls arranged below the heel cup, wherein the plurality of side walls comprises a rear side wall, at least one other side wall forming an aperture therebetween, two substantially parallel lateral side walls, and two substantially parallel medial side walls; and at least one tension element interconnecting and extending between all of the side walls and the heel cup, the tension element configured to provide resistance to deformation of the side walls, wherein the heel cup, the plurality of side walls, and the at least one tension element are integrally made as a single piece.

2. The sole of claim 1, wherein at least one of the side walls defines an aperture therethrough.

3. The sole of claim 2, wherein at least one of the side walls defines more than one aperture therethrough.

4. The sole of claim 1, wherein at least one side wall comprises an outwardly directed curvature.

5. The sole of claim 1, wherein the tension element engages at least two of the plurality of side walls substantially at a central region of the respective side walls.

6. The sole of claim 1, wherein the tension element extends below the heel cup and is connected to a lower surface of the heel cup at a central region of the heel cup.

7. The sole of claim 1, wherein the heel part comprises a substantially horizontal ground surface that interconnects lower edges of at least two of the plurality of side walls.

8. The sole of claim 7, wherein an outer perimeter of the horizontal ground surface extends beyond the lower edges of the side walls.

9. The sole of claim 7, wherein the heel part further comprises at least one reinforcing element, the at least one reinforcing element extending in an inclined direction from the horizontal ground surface to at least one of the plurality of the side walls.

10. The sole of claim 9, wherein the at least one reinforcing element extends from a central region of the horizontal ground surface to the at least one of the plurality of side walls.

11. The sole of claim 10, wherein the at least one reinforcing element and the tension element substantially coterminate at the at least one of the plurality of side walls.

12. The sole of claim 9, wherein at least one of the heel cup, the side walls, the tension element, and the reinforcing elements has a different thickness than at least one of the heel cup, the side walls, the tension element, and the reinforcing elements.

13. The sole of claim 9, wherein a thickness of at least one of the heel cup, the side walls, the tension element, and the reinforcing elements varies within at least one of the heel cup, the side walls, the tension element, and the reinforcing elements.

14. The sole of claim 1, wherein the heel part is manufactured by injection molding a thermoplastic urethane.

15. The sole of claim 1, wherein the heel part is manufactured by multi-component injection molding at least two different materials.

16. The sole of claim 1, wherein the heel part is substantially free from a foamed material.

17. The sole of claim 1 further comprising a skin at least partially disposed over the aperture.

* * * * *